US006808289B2

(12) United States Patent
Reed

(10) Patent No.: US 6,808,289 B2
(45) Date of Patent: Oct. 26, 2004

(54) METHOD AND APPARATUS FOR FLEXIBLE LED LAMP

(75) Inventor: David Reed, Sebastopol, CA (US)

(73) Assignee: RPM Optoelectronics, LLC, Santa Rosa, CA (US)

( * ) Notice: Subject to any disclaimer, the term of this patent is extended or adjusted under 35 U.S.C. 154(b) by 0 days.

(21) Appl. No.: 10/170,490

(22) Filed: Jun. 12, 2002

(65) Prior Publication Data

US 2003/0016532 A1 Jan. 23, 2003

Related U.S. Application Data

(60) Provisional application No. 60/306,800, filed on Jul. 20, 2001.

(51) Int. Cl.[7] ..... F21L 4/04

(52) U.S. Cl. ..... 362/198; 362/394; 362/246; 362/205; 362/251; 362/396

(58) Field of Search ..... 362/395, 191, 362/198, 184, 230, 246, 394, 205, 33, 97, 194, 234, 251, 253, 800, 396

(56) References Cited

U.S. PATENT DOCUMENTS

| | | | | |
|---|---|---|---|---|
| 866,473 | A | 9/1907 | Keefe et al. | 248/326 |
| 1,010,335 | A | 11/1911 | Williams | 362/270 |
| 1,340,108 | A | 5/1920 | Blasco | 248/124.1 |
| 1,692,394 | A | 11/1928 | Sundh | 362/198 |
| 1,735,212 | A | 11/1929 | Pawsat | 248/229.24 |
| 1,790,500 | A | 1/1931 | Fischer | 248/100 |
| 2,102,023 | A | 12/1937 | Overbury | 600/249 |
| 3,111,277 | A | 11/1963 | Grimsley | 362/197 |
| 3,381,122 | A | 4/1968 | Boyle, Jr. | 362/99 |
| 3,543,017 | A | 11/1970 | Milhailoff | 362/86 |
| 3,564,231 | A | 2/1971 | Bruce et al. | 362/558 |
| 3,582,536 | A | 6/1971 | Miller | 174/102 D |
| 3,666,938 | A * | 5/1972 | Dolega | 362/398 |
| 3,766,374 | A | 10/1973 | Fairchild | 362/567 |
| 3,923,372 | A | 12/1975 | Roland | 385/115 |
| 4,004,143 | A | 1/1977 | Good et al. | 362/131 |
| 4,106,082 | A | 8/1978 | Laeng et al. | 362/87 |
| 4,385,344 | A | 5/1983 | Gonser | 362/573 |
| 4,432,042 | A | 2/1984 | Zeller | 362/183 |
| 4,449,171 | A | 5/1984 | Warshawsky | 362/413 |
| 4,464,706 | A | 8/1984 | Steeves, Jr. | 362/193 |
| D281,820 | S | 12/1985 | Oba et al. | 409/50 |
| D282,011 | S | 12/1985 | Fackert | 54/58 |
| 4,605,990 | A | 8/1986 | Wilder et al. | 362/581 |
| 4,796,162 | A | 1/1989 | Krogsrud | 362/33 |
| 4,811,110 | A | 3/1989 | Ohmura et al. | 358/400 |
| 4,843,530 | A | 6/1989 | Mori et al. | 362/413 |
| 4,870,964 | A | 10/1989 | Bailey, Jr. et al. | 606/6 |
| 4,885,667 | A | 12/1989 | Selden | 362/253 |
| 4,893,222 | A | 1/1990 | Mintzer | 362/109 |
| 4,965,708 | A | 10/1990 | Louis | 362/598 |
| D312,885 | S | 12/1990 | Louis | 222/52 |
| 5,033,528 | A | 7/1991 | Volcani | 160/351 |

(List continued on next page.)

*Primary Examiner*—Thomas M. Sember
*Assistant Examiner*—B Q T
(74) *Attorney, Agent, or Firm*—Blakely, Sokoloff, Taylor & Zafman LLP

(57) ABSTRACT

A flexible light emitting diode (LED) lamp. The flexible LED lamp includes a base, an LED lamp head, and a flexible mid region disposed between the base and the LED lamp head. The LED lamp head is detachable or replaceable to obtain different colors, upgrade to improved LED lighting technology, or replace a defective component. The LED lamp head includes one or more LEDs coupled to a printed circuit board and a lens to spread the light generated by the LEDs to provide a larger area of illumination. The base of the flexible LED lamp has a clip to couple an object, such as a music stand, table or a book case. The flexible mid region allows the LED lamp head to be moved into a position where illumination is desired.

68 Claims, 10 Drawing Sheets

U.S. PATENT DOCUMENTS

| | | | | | |
|---|---|---|---|---|---|
| 5,083,252 | A | * | 1/1992 | McGuire | 362/293 |
| 5,172,974 | A | | 12/1992 | Riban | 362/109 |
| 5,268,826 | A | | 12/1993 | Greene | 362/103 |
| 5,276,596 | A | | 1/1994 | Krenzel | 362/191 |
| 5,369,556 | A | | 11/1994 | Zeller | 431/344 |
| 5,383,633 | A | | 1/1995 | Ellestad | 248/160 |
| 5,385,500 | A | | 1/1995 | Schmidt | 446/73 |
| 5,398,176 | A | | 3/1995 | Ahuja | 362/253 |
| D369,429 | S | | 4/1996 | Huang | 14/71.1 |
| D370,077 | S | | 5/1996 | Huang | 172/663 |
| 5,517,392 | A | | 5/1996 | Rousso et al. | 362/198 |
| 5,521,803 | A | | 5/1996 | Eckert et al. | 362/198 |
| D370,549 | S | | 6/1996 | Huang | 165/74 |
| 5,603,562 | A | | 2/1997 | Huang | 362/96 |
| 5,632,553 | A | | 5/1997 | Huang | 362/410 |
| D386,803 | S | | 11/1997 | Swanson | 56/190 |
| 5,687,774 | A | | 11/1997 | Chiang | 138/121 |
| D390,990 | S | | 2/1998 | Yang | 307/36 |
| 5,879,075 | A | | 3/1999 | Conner et al. | 362/551 |
| 5,944,407 | A | * | 8/1999 | Lynch et al. | 362/198 |
| 6,322,226 | B1 | * | 11/2001 | Dickson | 362/33 |
| 6,402,339 | B1 | * | 6/2002 | Mukogawa et al. | 362/184 |

* cited by examiner

METHOD AND APPARATUS FOR FLEXIBLE LED LAMP

CROSS-REFERENCE TO RELATED APPLICATIONS

This United States (US) non-provisional patent application filed by David Reed claims the benefit of U.S. provisional patent application Ser. No. 60/306,800, filed by David Reed on Jul. 20, 2001, entitled "METHOD AND APPARATUS FOR FLEXIBLE LED LAMP".

FIELD OF THE INVENTION

The invention relates generally to the field of lighting. Particularly, the invention relates to flexible lamps.

BACKGROUND OF THE INVENTION

Prior flexible lamps have typically provided illumination by using fluorescent, incandescent or halogen lighting technology. These types of lighting technology use fluorescent, incandescent or halogen bulbs, respectively. These bulbs tend to be fragile and can break if not carefully handled. Furthermore, these bulbs have a limited lifetime and can burn out when filaments therein are depleted and break. Once burned out, a new bulb needs to replace the burned out bulb before the lamp can function again.

Additionally, incandescent and halogen lighting are inefficient lighting technologies. The inefficiency results in the generation of heat. The heat generated tends to make bulbs hot to touch and may require shielding. Fluorescent fixtures are oftentimes noisy due to the balances and they sometimes emit radio frequency interference which can interfere with desirable radio frequency signals.

Furthermore, halogen lighting requires a significant power source and is not often used in battery operated applications. While fluorescent and incandescent lighting are used in battery operated applications, further improvement in energy efficiency is desirable to extend battery life and reduce energy costs from power line sources.

BRIEF DESCRIPTION OF THE DRAWINGS

Like reference numbers and designations in the drawings indicate like elements providing similar functionality.

DETAILED DESCRIPTION OF THE INVENTION

In the following detailed description of the invention, numerous specific details are set forth in order to provide a thorough understanding of the invention. However, it is to be understood that the invention may be practiced without these specific details. In other instances well known methods, procedures, components, and circuits have not been described in detail so as not to unnecessarily obscure aspects of the invention.

A flexible light emitting diode (LED) lamp. The flexible LED lamp includes a base, an LED lamp head, and a flexible mid region disposed between the base and the LED lamp head. The LED lamp head is detachable or replaceable to obtain different colors, upgrade to improved LED lighting technology, or replace a defective component. The LED lamp head includes one or more LEDs coupled to a printed circuit board and a lens to spread the light generated by the LEDs to provide a larger area of illumination. The base of the flexible LED lamp has a clip to couple an object, such as a music stand, table or a book case. The flexible mid region allows the LED lamp head to be moved into a position where illumination is desired.

Figure 1:
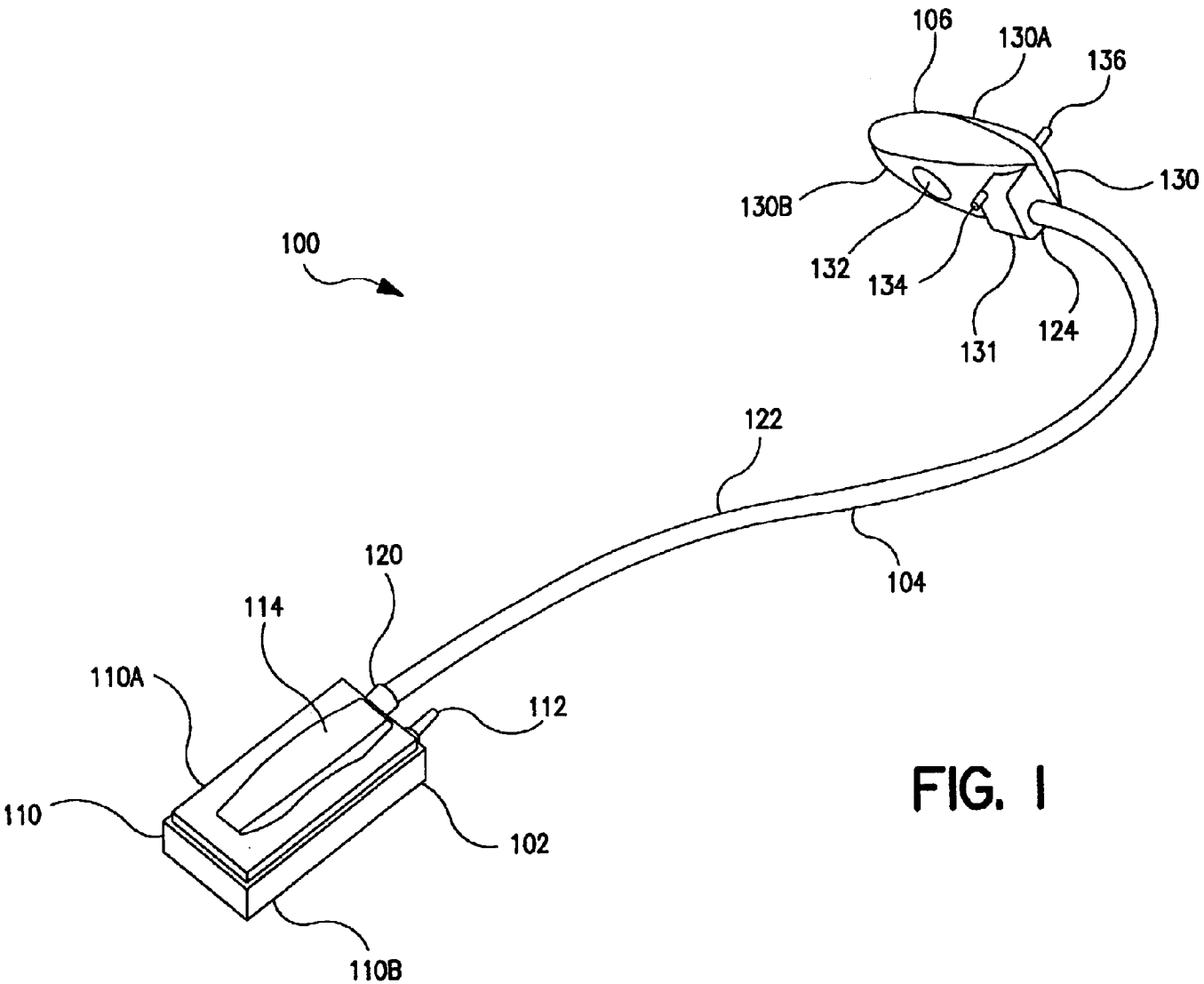
FIG. 1 is a perspective view of a flexible LED lamp.

Referring now to FIG. 1 a flexible light emitting diode (LED) lamp 100 is illustrated. The flexible LED lamp 100 may also be referred to as a flexible LED light or a gooseneck LED lamp. The flexible LED lamp 100 uses no light bulb that can burn out and has no fragile bulb that may break and need replacing. The lighting provided by the flexible LED lamp 100 through its light emitting diodes or similar optoelectronic devices, is a cool light because it is efficient and need not heat a filament used in light-bulbs. The color of light generated by the flexible LED lamp can be factory programmed in one embodiment or user selectable to the color settings of red, amber, green, blue, and white or combinations thereof in another embodiment. The flexible LED lamp 100 utilizes sold-state technology including electrical to optical converters (i.e., light emitting diodes (LEDs)) in order to provide energy efficiency.

The flexible LED lamp 100 includes a base 102, a flexible mid region 104, and an LED lamp head 106. The base 102 may also be referred to as a power pack, battery pack, lamp support member or pedestal base. The flexible mid region 104 may also be referred to as a gooseneck, a flexible neck, a flexible tube, a flexible pipe, a flexible support member, or a flexible extension. The LED lamp head 106 may also be referred to as LED light head, or LED bulb head, and because it is detachable from the flexible mid region 104, it may also be referred to as a detachable LED lamp head, pluggable LED lamp head, a removable LED lamp head, or a variation thereof.

The LED lamp head 106 includes a receptacle to receive a plug at the end of the flexible mid region 104. Alternatively, the LED lamp head 106 may include a plug and the flexible mid region 104 may include a receptacle at an end to receive the plug of the LED lamp head 106.

The base 102 includes a housing 110, a battery ON/OFF switch 112, a regulator, and a clip or clamp 114. The housing 110 includes an upper half housing 110A and a lower half housing 110B. The battery ON/OFF switch 112 switches the power supplied by the one or more batteries to the electronics of the LED lamp head 106 on and off. Energy of the one or more batteries can be conserved by decoupling the one or more batteries from the control electronics in the LED lamp head 106. The regulator (functional block shown in FIG. 10) regulates the power to proper voltage (including a step down in voltage in one embodiment) and current levels for the LED lamp head 106.

The clip or clamp 114 allows the base to couple to objects such as a music stand, table, book case, or other objects. The object is held between the upper-half housing 110A and the clip or clamp 114. Other bases, clips or clamps used for lamps or lights found in the prior art can be used to provide support and coupling to objects such as those found in U.S. Pat. Nos. 1,010,335; 1,340,108; 1,692,394; 1,735,212; 1,790,500; 3,111,277; 3,381,122; 3,543,017; 3,666,938; 4,449,171; 4,432,042; 4,796,162; 4,965,708; 4,605,990; 5,172,974; 5,268,826; 5,879,075; and 5,944,407 for example.

The housing 110 of the base 102, including the upper half housing 110A and the lower half housing 110B, in one embodiment is molded out of plastic. In another embodiment, the housing 110 of the base 102 may be formed out of a metal.

The flexible mid region 104 includes a threaded end 120, a flexible center 122, and a connector end 124. The threaded end 120 and the flexible center 122 are hollow to allow one or more electrical cables or wires to couple between the base 102 and the connector end 124. The one or more electrical cables or wires may carry power from the base 102 to the connector end 124. A connector of the lamp head 106 can couple to the connector end 124 in order to receive power.

The flexible center 122 is shaped as a flexible hollow cylinder and can be formed out of a flexible metal tube, a flexible plastic tube, or constructed as found in the prior art such as found in U.S. Pat. Nos. 1,692,394; 1,790,500; 3,582,536; 5,172,974; 5,521,803; 5,687,774; and 5,944,407 for example. In one embodiment, the flexible center 122 is a flexible hollow tube having a circular cylinder shape. In another embodiment, the flexible center 122 is a hollow tube having a rectangular cylinder shape.

The connector end 124 allows the LED lamp head 106 to be exchanged for another, if a different single-color LED lamp head is desired, or if a variable or multi-color LED lamp head is desired.

Other flexible mechanisms for lamps or lights found in the prior art can be used for the flexible mid region 104 such as flexible arms, movable joints, telescopic or extendable (i.e. expandable or slideable) and/or rotatable tubes such as found in U.S. Pat. Nos. 1,010,335; 1,340,108; 1,735,212; 3,381,122; 3,543,017; 4,449,171; 4,432,042; 4,796,162; and 4,965,708 for example.

The LED lamp head 106 includes a lamp housing 130, a lens 132, and an intensity/ON/OFF switch 134. For a multicolor lamp head, an optional color switch 136 can be further included as part of the LED lamp head 106 to allow a change of colors in the light output. If a single color is desirable, the optional color switch 136 need not be used.

The LED lamp head 106 and the lamp housing 130 may be shaped similar to a snake's head as illustrated. The lamp housing 130 includes an upper half lamp housing 130A and a lower half lamp housing 130B. The lamp housing 130 is hollow and provides support for a printed circuit board (not shown in FIG. 1). The lamp housing 130 includes an engagement portion 131 to provide sufficient support for the lamp head 106 when coupled to the flexible mid region 104. The lamp housing 130 includes a lens opening to hold the lens 132, button openings (404 and 408 shown in FIG. 4) to allow buttons or rotating elements to extend therefrom (including buttons/rotating elements of the intensity/ON/OFF switch 134 and the optional color switch 136 to switch or change their settings), and a connector opening to allow the connector end 124 to couple to a connector of the LED lamp head 106.

The lens 132 couples into the lens opening of the lamp housing 130 to collimate and disperse or diffuse the light generated by the LED lamp head 106. The intensity/ON/OFF switch 134 can be a pushbutton switch which changes from ON high to ON low to OFF in sequence. The optional color switch 136 can be a pushbutton switch that varies the color or hue of the light generated by the LEDs in the case of a multi-color LED lamp head 106.

The LED lamp head 106 can be a single color LED lamp head or a multicolor LED lamp head. A single color LED lamp head can provide a single color of light formed out of the primary colors red, green or blue. A multi-color LED lamp head can provide variations in color of the light output from proportionally combining the primary colors red, green or blue. Additionally, white LEDs may be utilized in order that the LED lamp head 106 provide a white light output. Alternatively, a combination of red, green and blue LEDs can be used in order to generate a white light output from the LED lamp head 106.

The dimensions of the flexible LED lamp 100 may be relatively small such that it is compact and very portable. The dimensions of housing 130 of the LED lamp head 106 may be about three inches long, one and one-quarter inches in height, and one and three-quarter inches wide for example. The length of the flexible mid region 104 can be about twenty inches for example. The base 103 can be about four and one half inches long, two inches wide and three-fourths of an inch high for example.

Figure 2:
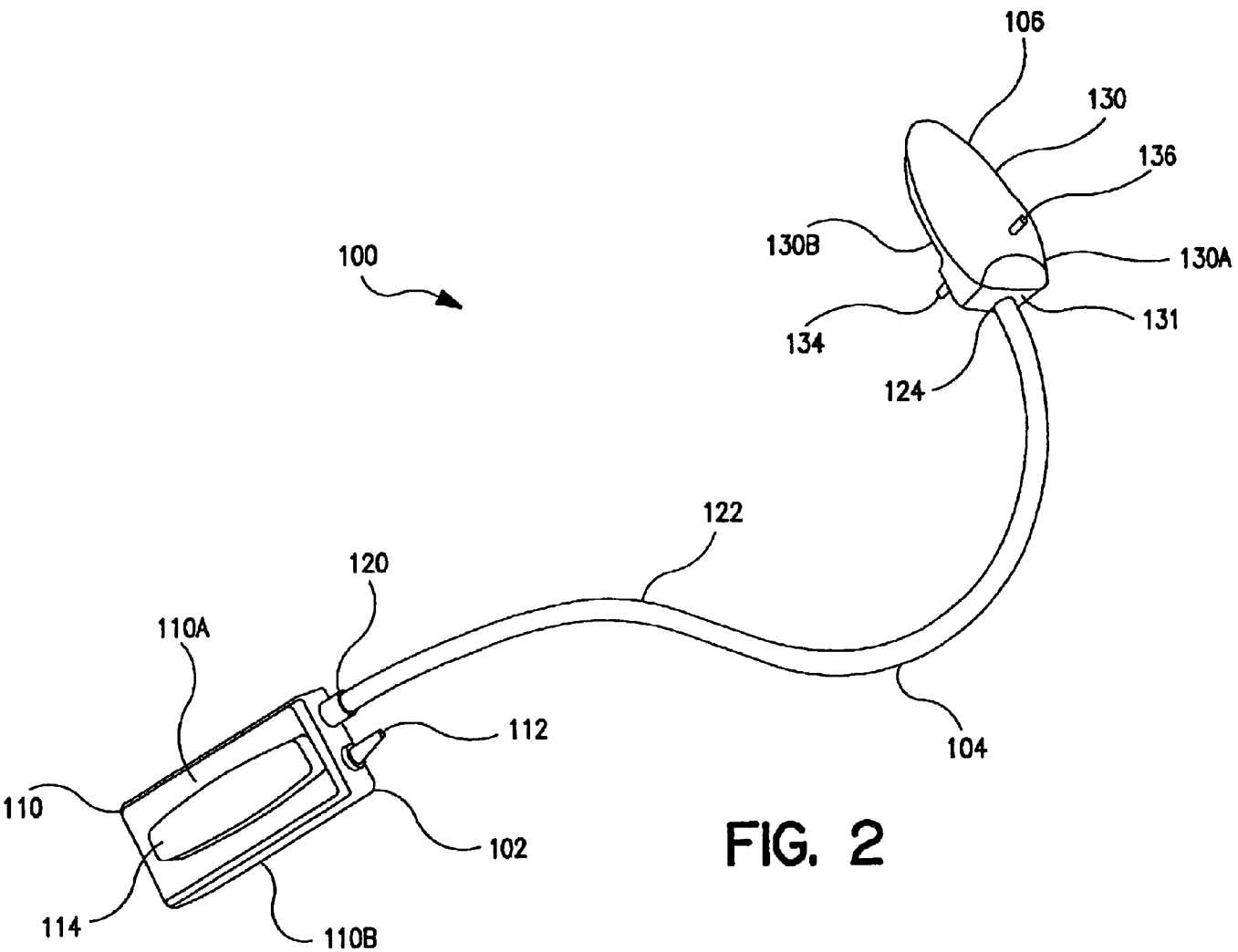
FIG. 2 is another perspective view of the flexible LED lamp.

Referring now to FIG. 2, the flexible LED lamp 100 is illustrated with the LED lamp head 106 positioned differently to show the flexibility in the flexible mid region 104. FIG. 2 more clearly illustrates a top of the upper half lamp housing 130A.

Figure 3A:
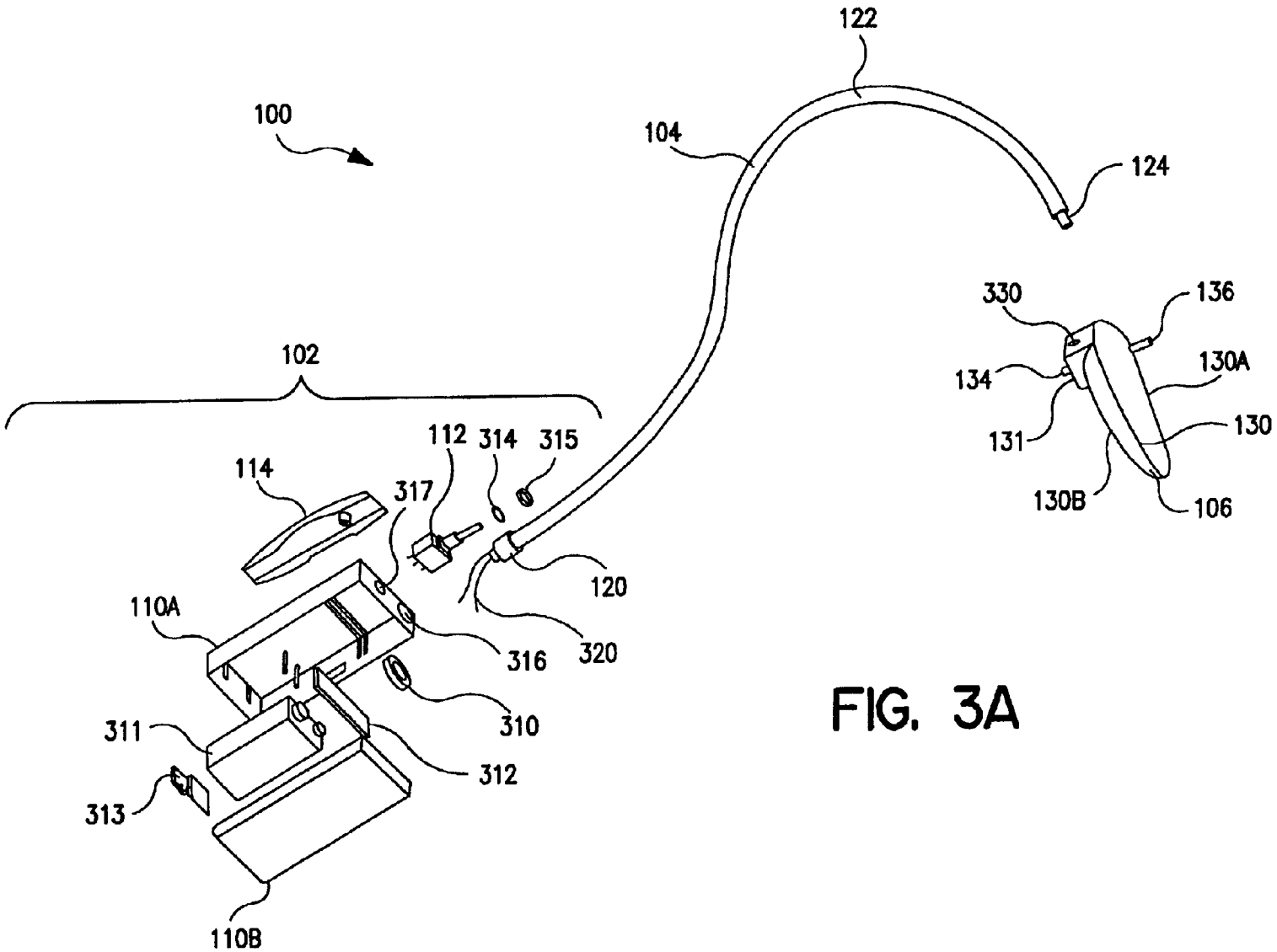
FIG. 3A is a disassembled illustration of the flexible LED lamp with an exploded view of a base.

Referring now to FIG. 3A, a disassembled view of the flexible LED lamp 100 is illustrated. FIG. 3A also illustrates an exploded view of the base 102 and the internal components that it may include. The base 102, illustrated in FIG. 3A, includes the upper half housing 110A, the lower half housing 110B, the battery ON/OFF switch 112, the clip or clamp 114, a threaded nut 310, one or more batteries 311, a battery connector plate 312, a pressure plate 313, a washer 314, a threaded nut 315, a first opening 316 in the housing 110, and a second opening 317 in the housing 110. One or more wires coupling the battery connector plate 312 to the battery ON/OFF switch 112 are not illustrated.

After the threaded end 120 is inserted into the opening 316, the threaded nut 310 can be screwed onto the threads of the threaded end 120 and tightened to couple the flexible mid region 104 to the base 102. Any wires, such as one or more wires 320, extending from flexible mid region 104 out of the threaded end 120 can be coupled to the battery ON/OFF switch 112, the battery connector plate 312, or other electrical component as may be needed.

The battery ON/OFF switch 112 can have its button, toggle or actuator portion inserted into the opening 317 so that a threaded portion just extends out beyond the housing 110 and the washer 314 and the nut 315 can be coupled to the extending threaded portion, thereby coupling the battery ON/OFF switch 112 to the base 102.

The flexible mid region 104 includes the threaded end 120, the flexible center 122, the connector end 124, and the one or more wires or cables 320 extending out from the threaded end 120. The one or more wires or cables 320 are for coupling to the electrical components in the base 102 at one end and the connector end 124 at an opposite end. The one or more wire cables 320 are routed within the hollow portion of the flexible mid region 104 from the connector end 124 and out through the threaded end 120.

FIG. 3A illustrates the LED lamp head 106 including the lamp housing 130 (upper half 130A and lower half 130B), the intensity/ON/OFF switch 134, the optional color switch 136, and a connector 330 at the engagement portion 131 of the lamp housing 130. Lens 132 of the LED lamp head 106 is not shown in FIG. 3A. The connector 330 is to receive the connector end 124 of the flexible mid region 104 in order to mechanically support the LED lamp head 106 and provide power to the electronic components contained therein. The LED lamp head 106 is preferably made as light as possible to avoid undue forces on the connector 330 and the connector end 124 of flexible mid region 104. The lamp housing 130, including the upper half 130A and the lower half 130B, are made of plastic to form a hollow plastic housing in one embodiment.

Figure 3B:
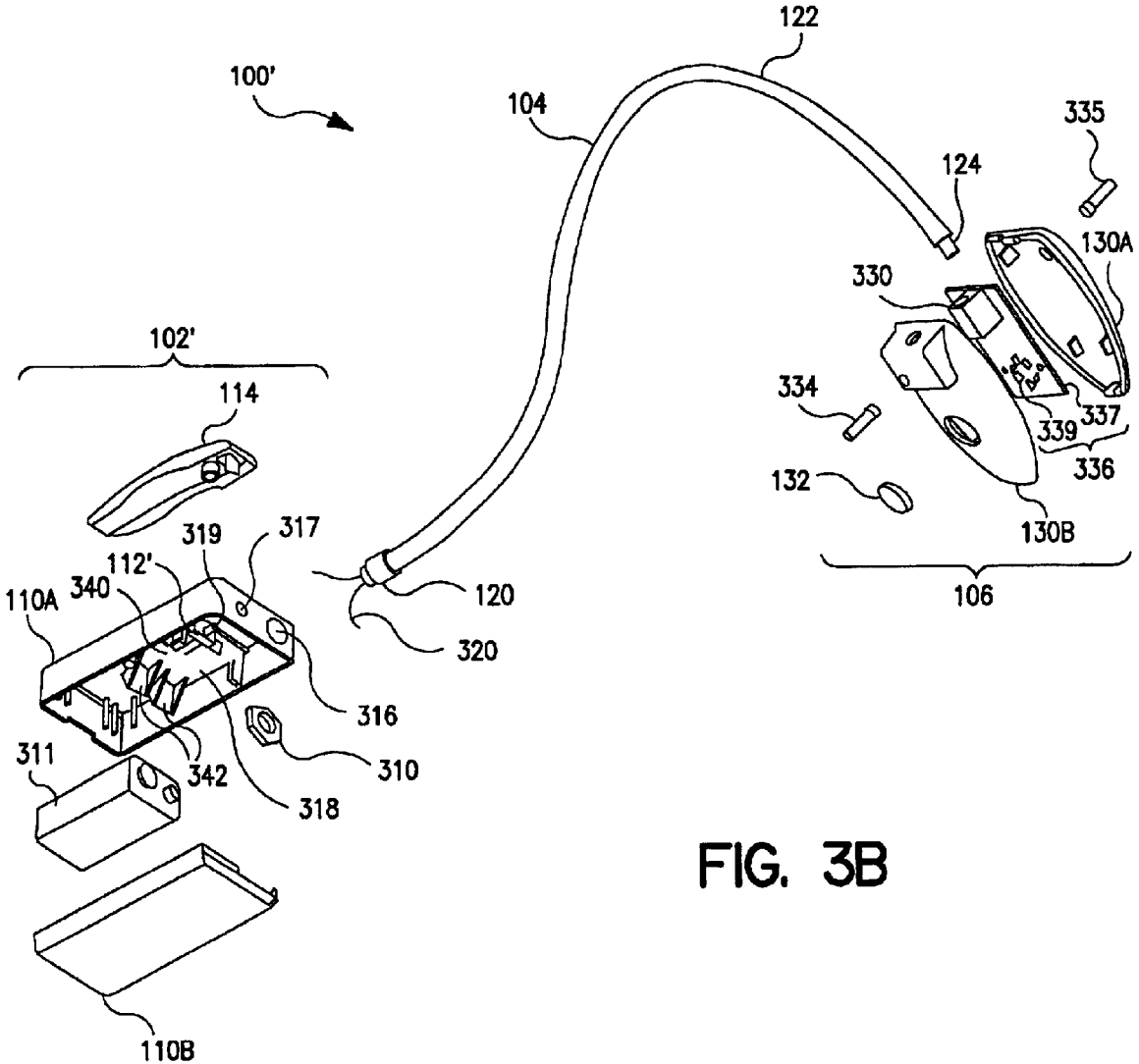
FIG. 3B is a disassembled illustration of the flexible LED lamp with an exploded view of an alternate base.

Referring now to FIG. 3B, a disassembled view of a flexible LED lamp 100' is illustrated. The flexible LED lamp 100' also illustrates exploded views of an alternate base 102' and the internal components that it may contain, and the LED lamp head 106 and the internal components the LED lamp head may contain.

The alternate base 102', illustrated in FIG. 3B, includes the upper half housing 110A, the lower half housing 110B, a battery ON/OFF slider switch 112', the clip or clamp 114, the threaded nut 310, the one or more batteries 311, the first opening 316 in the housing 110, the second opening 317 in the housing 110, and a base electrical subassembly 318. The base electrical subassembly 318 includes a printed circuit board 340, the battery ON/OFF slider switch 112' coupled thereto, and a pair of battery connectors 342 to couple to terminals of the one or more batteries 311. The printed circuit board 340 further includes wire traces (not illustrated) to couple between the battery connectors 342, the switch 112', and terminals to couple to the one or more wires 320 of the flexible mid region 104. As the electrical subassembly is mounted into the upper half housing 100A, a slider tab 319 of the switch 112' is inserted into the opening 317 from the inside of the housing 110 to extend through and allow user access to it. A user can actuate the switch 112' by moving the slider tab 319 back and forth. Other types of switches may be also used for the battery ON/OFF switch 112, including toggle switches and push button switches. The slider switch 112' couples well to the printed circuit board 340 to provide an integrated electrical subassembly 318.

In FIG. 3B, the LED lamp head 106 includes the lamp housing 130 (upper half 130A and lower half 130B), the lens 132, a button 334 for the intensity/ON/OFF switch 134, an optional button 335 for the optional color switch 136 (for the multicolor lamp head), and a lamp electrical subassembly 336.

The lamp electrical subassembly 336 includes the connector 330 for coupling to the connector end 124 of the flexible mid region 104, a printed circuit board 337, and one or more electrical-to-optical (EO) converters 339 to generate a light source. The lamp electrical subassembly 336 is further described below with reference to FIG. 4. As previously described, the lamp housing 130 is molded out of plastic in one embodiment.

The one or more electrical-to-optical converters 339 are optoelectronic devices which convert electrical energy (voltage/current) into optical energy (light/photons), such as light emitting diodes or laser diodes. That is, the one or more electrical-to-optical (EO) converters 339 are transducers which convert electrons of an electrical signal into a light source or photons of an optical signal. Light emitting diodes (LEDs) emitting light in the visible spectrum are preferably used as the one or more electrical-to-optical converters 339.

In one embodiment, six LEDs are used (one red, two blue, and three green) to allow the varying colors to be generated in a multicolor lamp head. The current to each of the red, green, and blue LEDs can be individually varied to select a mixture of primary colors to generate the color of light. In another embodiment, five LEDs are used of the same color (five red, five blue, five green, or five white) to generate light of one color for a single color lamp head. In yet another embodiment, five LEDs (one red, two blue, and three green) are used with a factory set intensity of each in order to generate white light.

The base 102 and the base 102' illustrated in FIGS. 3A–3B respectively, may also include an opening in its housing 110, and a connector for a DC line power plug in order to power the flexible LED lamp 100 (not shown in FIGS. 3A–3B). The one or more batteries 311 may be rechargeable batteries that can be recharged by the DC line power. The DC line power can be generated by using a transformer and rectifier coupled to AC line power.

Figure 4:
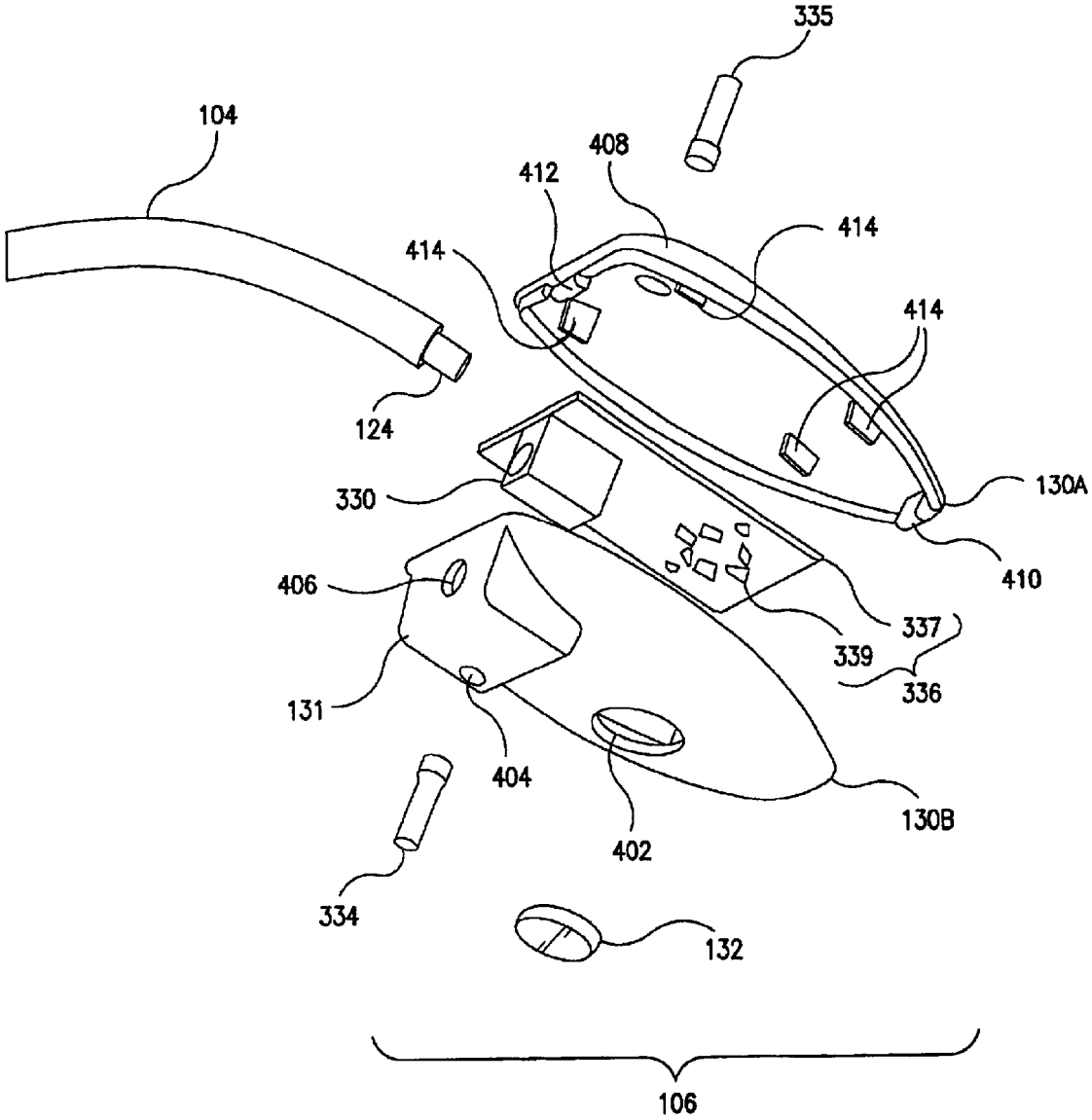
FIG. 4 is a magnified exploded view of the LED lamp head and a portion of the flexible mid region.

Referring now to FIG. 4, a magnified exploded view of the LED lamp head 106 and a magnified portion of the flexible mid region 104 are illustrated. The lower-half lamp housing 130B includes a lens opening 402 at a bottom region, a button opening 404 in a bottom region of the engagement portion 131, and a connector opening 406 in a back region of the engagement portion 131. The upper-half lamp housing 130A includes a button opening 408 in a top region. The upper-half lamp housing 130A further includes a first locking tab 410 at a front region and a second locking tab 412 at a back region extending from inside the upper-half lamp housing 130A to couple to a front slot and a back slot in the lower-half lamp housing 130B. The locking tabs 410, 412 and slots couple together to hold the upper-half lamp housing 130A and the lower-half lamp housing 130B together as the lamp housing 130. The upper-half lamp housing 130A also includes one or more press tabs 414 to press down on the printed circuit board 337 of the lamp electrical subassembly 336.

In one embodiment, the buttons 334 and 335 are clear plastic such that light generated inside the lamp head 104 can be directed through them to illuminate the location of the buttons. This allows a user to locate and adjust the lighting in dark conditions.

The lamp electrical subassembly 336 includes the connector 330 for coupling to the connector end 124 of the flexible mid region 104, the printed circuit board 337, and the one or more electrical-to-optical (EO) converters 339. The one or more EO converters 339 and the connector 330 are coupled to the printed circuit board 337. In one embodiment, the one or more EO converters 339 are arranged around a circle having a center that aligns with the optical axis of the lens 132. Each optical axis of the one or more EO converters may be spaced apart equally around the circle with the same distance from the center of the circle. The optical axis of each EO converter 339 points into the lens 132 when the LED lamp head is assembled together.

"The connector 330 fits into the engagement region 131 of the lower half lamp housing 130B. In one embodiment, the connector 330 and the connector end 124 are standard barrel connectors either of which can be female (a "barrel jack") or male (a "barrel plug") respectively in order to couple together. The connector 330 and the connector end 124 allow the LED lamp head to plug and unplug from the flexible mid region 104 and the lamp. Thus, one lamp head can easily be replaced with another lamp head. Furthermore with standard barrel connectors being used as the connector 330 and the connector end 124, the lamp head can swivel on the end of the flexible mid region 104. Thus, the lamp head has a large range of motion with respect to the base. "

Figure 5B:
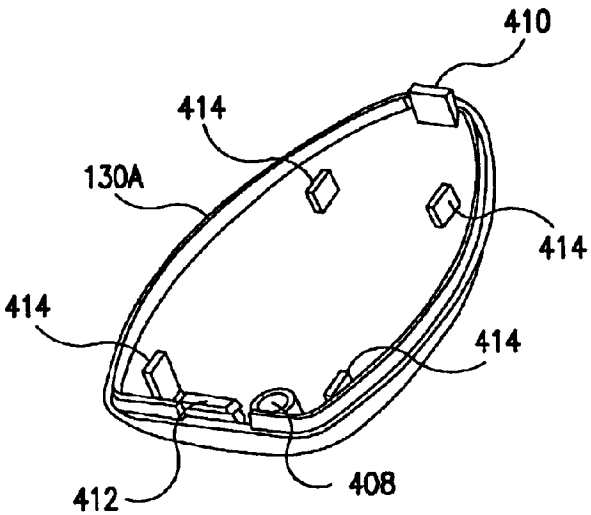
FIG. 5B is a top view of the upper-half lamp housing for the LED lamp head.
Figure 5A:
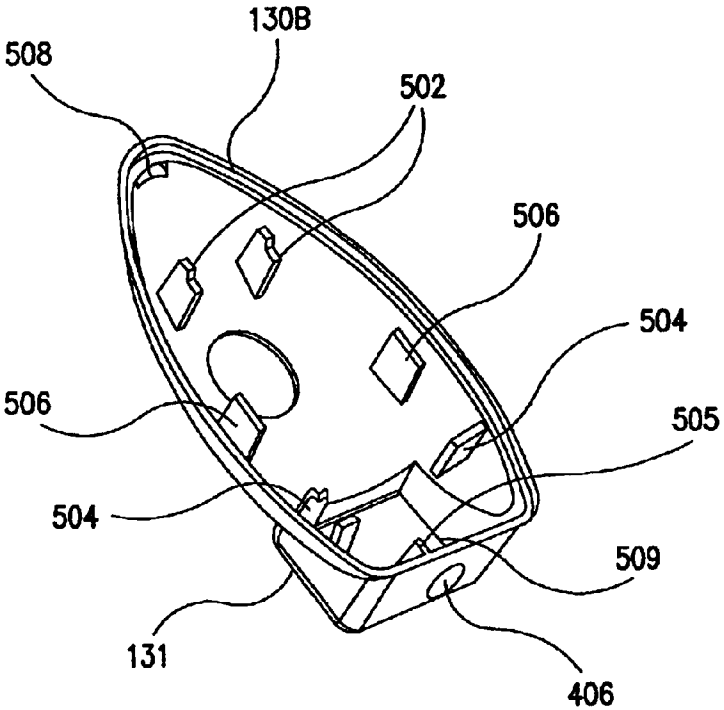
FIG. 5A is a top view of the lower-half lamp housing for the LED lamp head.

Referring now to FIG. 5A, a top view of the lower-half lamp housing 130B is illustrated. The lower-half lamp housing 130B further includes a pair of front printed circuit board (PCB) rests 502, a pair of rear PCB rests 504, a rear PCB guide tab 505, and a pair of side PCB guide tabs 506. The front PCB rests 502 include a cutout into which the printed circuit board 337 of the lamp electrical subassembly 336 fits which keeps it from moving forward when coupled to the connector 330 couples to the connector end 124 of the flexible mid region 104. The rear PCB rests 504 also include a pair of cutouts into which the printed circuit board 337 of the lamp electrical subassembly 336 fits which keeps it from moving sideways and the connector 330 aligned with the opening 406. An edge of the rear PCB guide tab 505 rises to the level of the PCB 337 to confine a rear edge of the PCB 337 and keep it from moving backward when the lamp head is disconnected and the connector 330 is uncoupled from the connector end 124 of the flexible mid region 104. Edges of the side PCB guide tabs 506 also rise to the level of the PCB 337 to confine its side edges and keep the PCB 337 from moving sideways in the lamp housing 130.

The lower-half lamp housing 130B further includes a front groove or slot 508 and a rear groove or slot 509 to couple to the locking tabs 410 and 412 respectively and hold the upper-half lamp housing 130A and the lower-half lamp housing 130B coupled together. A hook in each of the locking tabs 410 and 412 mates into the grooves or slots 508 and 509 respectively. The locking tabs 410 and 412 can be flexed to disassemble the LED lamp head 106 and repair or replace components if needed.

Referring now to FIG. 5B, a top perspective view of the upper-half lamp housing 130A is illustrated. The upper-half lamp housing 130A includes the button opening 408, the first locking tab 410, the second locking tab 412, and the one or more press tabs 414. The locking tabs 410, 412 couple to the grooves or slots 508, 509 respectively to hold together the upper-half lamp housing 130A and the lower-half lamp housing 130B together as the lamp housing 130. The one or more press tabs 414 press down on the printed circuit board 337 of the lamp electrical subassembly 336 to hold its position within the pair of front printed circuit board (PCB) rests 502, the pair of rear PCB rests 504, the back PCB guide tab 505, and the pair of side PCB guide tabs 506 of the lower half housing 130B.

Figure 6:
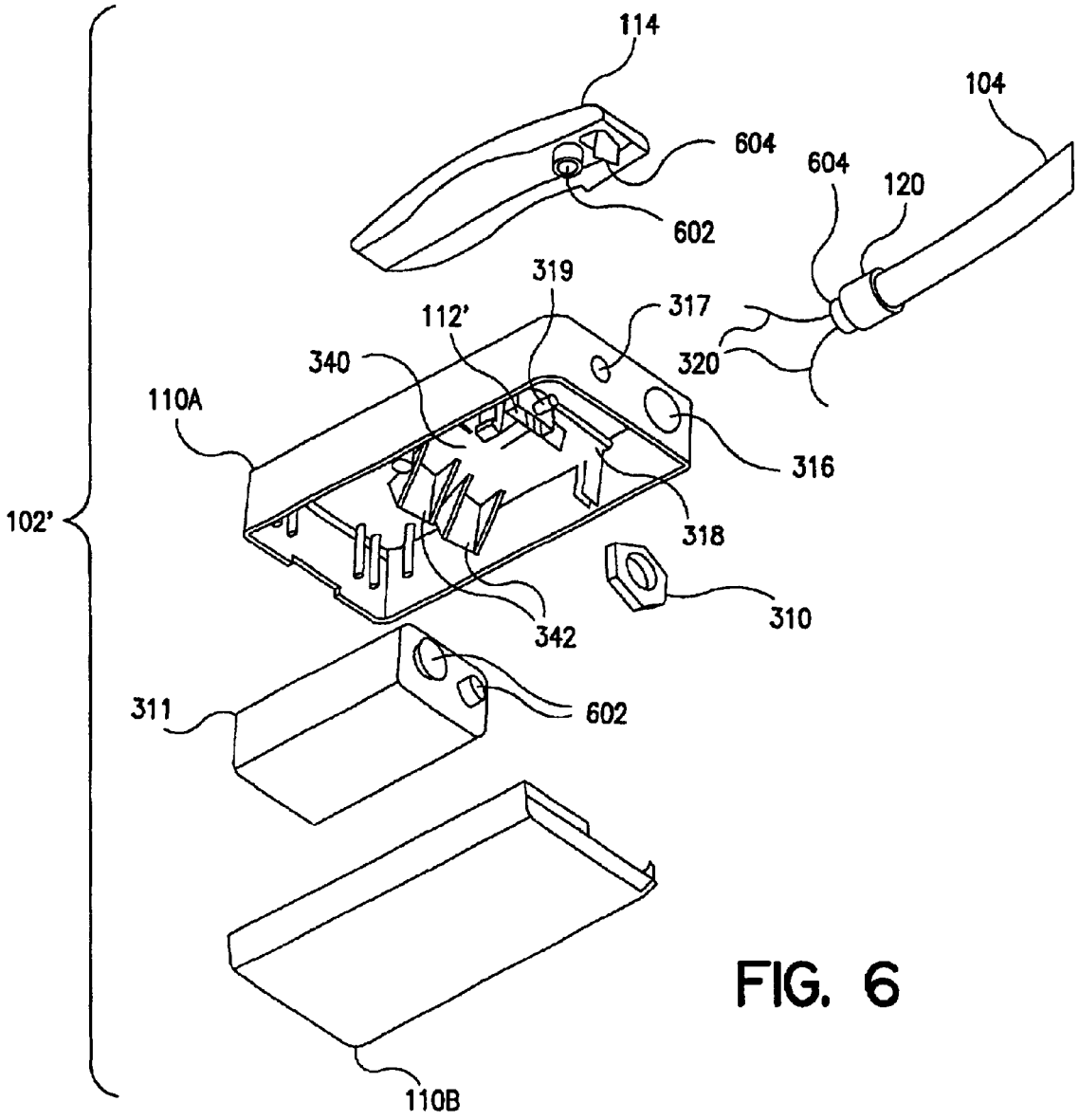
FIG. 6 is a magnified exploded view of the alternate base and a portion of the flexible mid region.

Referring now to FIG. 6, a magnified exploded view of the base 102' and a magnified portion of the flexible mid region 104 are illustrated.

The base 102' includes the upper half housing 110A, the lower half housing 110B, the battery ON/OFF slider switch 112', the clip or clamp 114, the threaded nut 310, the one or more batteries 311, the first opening 316 in the housing 110, the second opening 317 in the housing 110, and the base electrical subassembly 318. The base electrical subassembly 318 includes the switch 112' and a pair of battery connectors 342 coupled to the printed circuit board 340. In one embodiment, the one or more batteries 311 is a nine volt battery with positive and negative terminals 602 to couple to the pair of battery connectors 342. The clip or clamp 114 includes a screw mount 602 through which a screw can couple the clip to the upper-half housing 110A and act as a pivot point. The clip or clamp 114 may include a pivot stop 604 which can also include a spring to push the clip or clamp 114 near one end to lever the opposite end into an object and squeeze it against the upper-half housing 110A.

The one or more wires 320 of the flexible mid region 104 may couple to terminals of the printed circuit board 340 or directly to terminals of the switch 112'. The threaded end 120 of the flexible mid region 104 includes threads 604 to couple to the threads of the nut 310 and hold the flexible mid region 104 and the housing 102' coupled together.

Figure 7A:
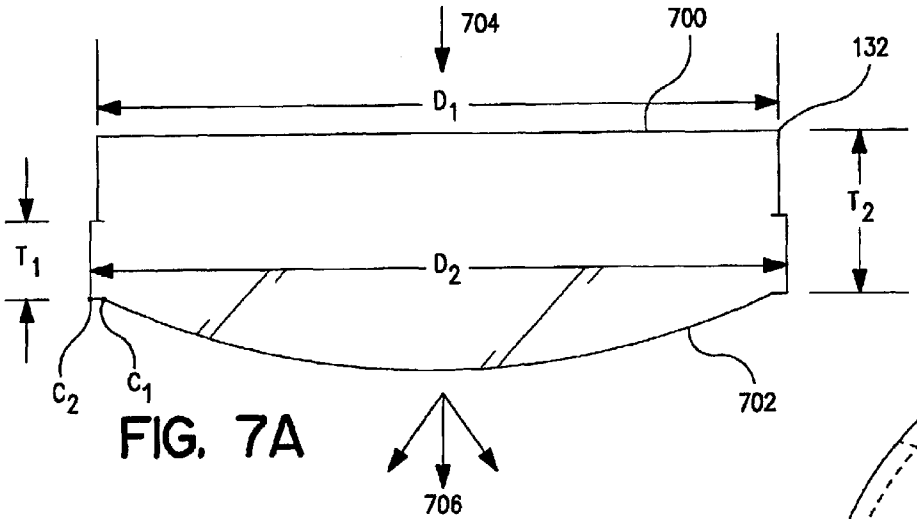
FIG. 7A is a cross section of the lens.
Figure 7B:
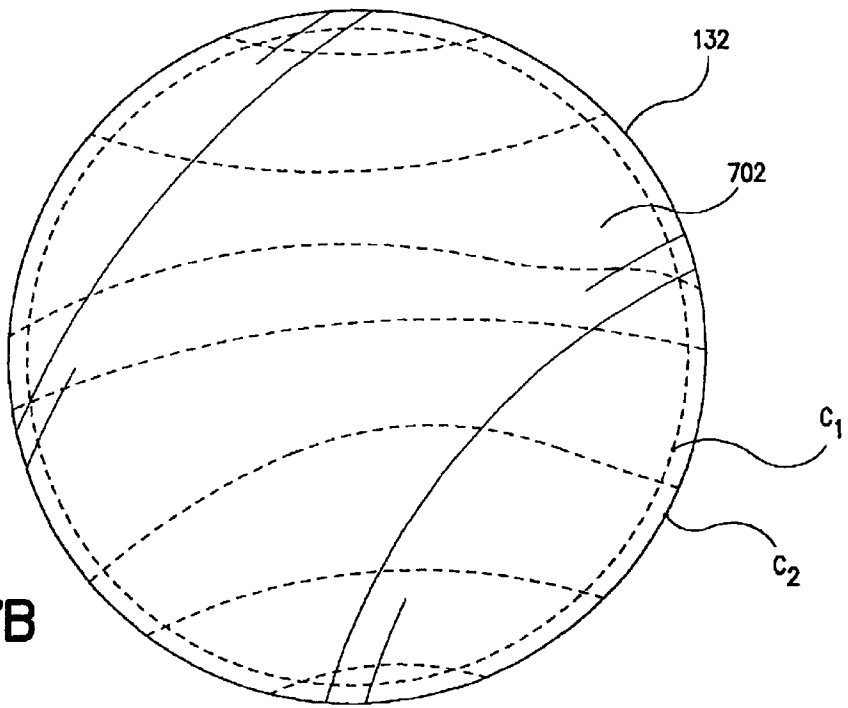
FIG. 7B is a bottom view of the lens.

Referring now to FIGS. 7A–7B, magnified views of the lens 132 are illustrated. The lens 132 press fits into the lens opening 402 of the lower-half lamp housing 130B of the LED lamp head 106. An epoxy or glue may be used around the edges of the lens 132 and the opening 402 to further hold it in place. The lens 132 may be formed out of polycarbonate, plastic, acrylic, glass, or other materials that can collimate, focus, disperse or diffuse visible wavelengths of light generated by the one or more electrical to optical converters 339.

FIG. 7A illustrates a magnified cross section of the lens 132. In one embodiment, the lens 132 is a circular collimating and diffusing lens to form a uniform light output. The lens 132 includes a top optical surface 700 and a bottom convex diffusing surface 702. Incident light 704 from the electrical to optical converters (i.e., LEDs) 339 enters the lens through the top optical surface 700, is collimated, focused and spread or dispersed outward, exiting through the bottom convex diffusing surface 702, as illustrated by the light rays 706. The convex diffusing surface 702 is a convex surface which is bead blasted to provide a pitted surface to further diffuse the light and spread it outward. The optical surface 700 is a relatively flat surface which is polished to an optical grade so that light can effectively enter and be focused by the lens 132 outward with little reflection.

In the case of color LEDs, the lens 132 diffuses or blends the individual colors into a single color output. In one case, incident light from red LEDs, green LEDs, and blue LEDs may be diffused together by the lens 132 into a single white color output light.

The lens 132 has a number of dimensions to collimate, focus and disperse light, as well as to mechanically couple into the lens opening 402 in the lower-half lamp housing 130B. The lens 132 has a first diameter D1 and a second diameter D2. The lens 132 further has a first side thickness T1 and a second side thickness T2. The approximate dimensions of these parameters are 0.543 inches for D1, 0.547 inches for D2, 0.037 inches for T1, and 0.075 inches for T2. The curvature of the convex diffusing surface 702 has an arc radius of approximately 0.75 radians.

FIG. 7B is a magnified view of the lens 132 from the bottom. The first diameter D1 forms a cylinder C1 while the second diameter D2 forms a cylinder C2 in the lens 132. The cylinder C1 mates into the opening 402 while the larger cylinder C2 keeps the lens 132 from being pushed into the lower-half lamp housing 130B. A glue, epoxy or other adhesive can be further used around the edge of the lens 132 and the opening 402 to hold them coupled together.

Figure 8A:
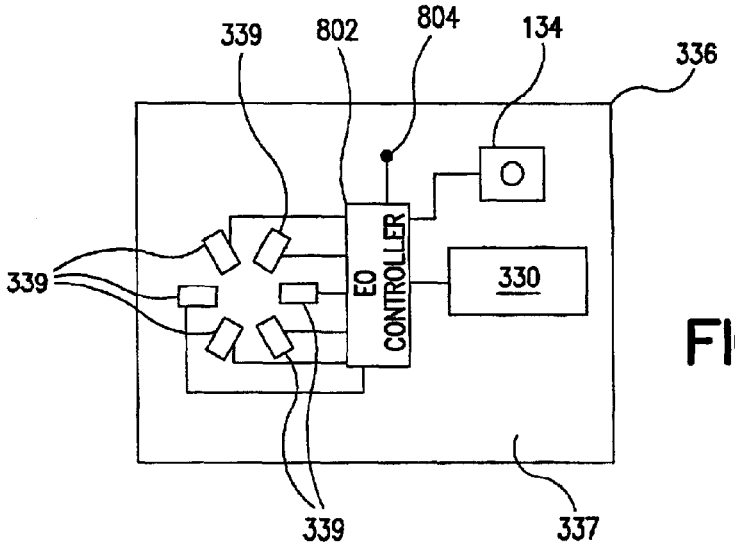
FIG. 8A is a bottom view of the lamp head electrical subassembly.

Referring now to FIG. 8A, a view of the bottom side of the printed circuit board 337 of the lamp electronic subassembly 336 is illustrated. The first side includes the intensity/ON/OFF switch 134, the connector 330, the one or more electrical-to-optical (EO) converters (i.e. LEDs) 339, and an electrical-to-optical (EO) controller 802.

The EO controller 802 is coupled to the one or more EO converters 339, the intensity/ON/OFF switch 134, and the connector 330. The EO controller 802 receives power from the one or more batteries 311 through the connector 330, if the battery ON/OFF switch 112 is switched ON. The EO controller 802 controls the amount of power provided to the EO converters 339 and thereby can control the light intensity as well as the color, if different color EO converters 339 are utilized.

Figure 8B:
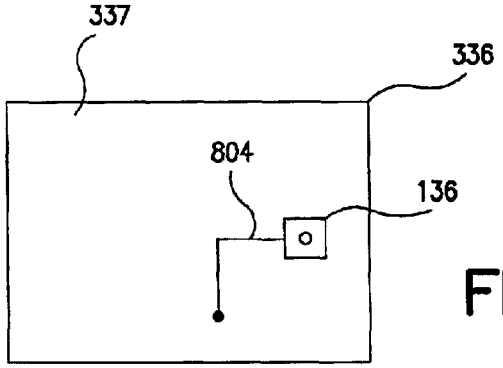
FIG. 8B is a top view of the lamp head electrical subassembly.

Referring now to FIG. 8B, a view of the top side of the printed circuit board 337 of the lamp electronic subassembly 336 is illustrated. The second side includes the optional color switch 136 which couples to the EO controller 802 through traces 804. A user switches the optional color switch 136 which is communicated to the EO controller 802 to select a desired color.

Figure 9:
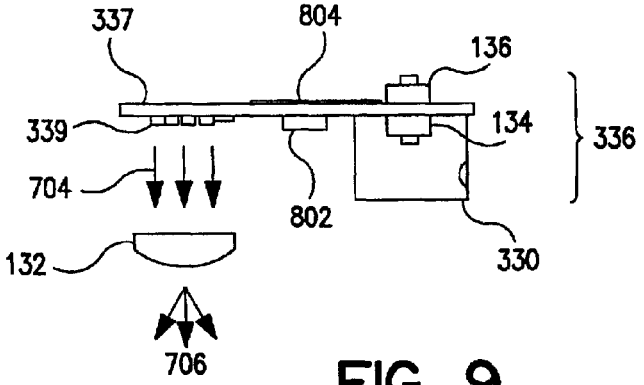
FIG. 9 illustrates a side view of the lamp head electrical subassembly aligned with the optical axis of the lens.

Referring now to FIG. 9, a side view of the lamp electronic subassembly 336 is illustrated in alignment with the lens 132, as they are to be positioned in the LED lamp head 106. In order to efficiently generate light, the one or more electrical-to-optical converters (EOs) 339 are aligned with the lens 132. Preferably they are aligned nearer the central optical axis of lens 132.

The connector 330 plugs onto the flexible mid region 104 of the flexible LED lamp 100, so the LED lamp head 106 can receive power. A user controls the color and the light intensity of the light generated by the one or more EO converters 339 by using the switches 134 and 136. The EO controller 802 receives input information from the user and causes the one or more EO converters (i.e., LEDs) 339 to generate photons forming the incident light source 704 onto the lens 132. The lens 132 receives the incident light source 704 and focuses and diffuses the light into the output light rays 706.

Figure 10:
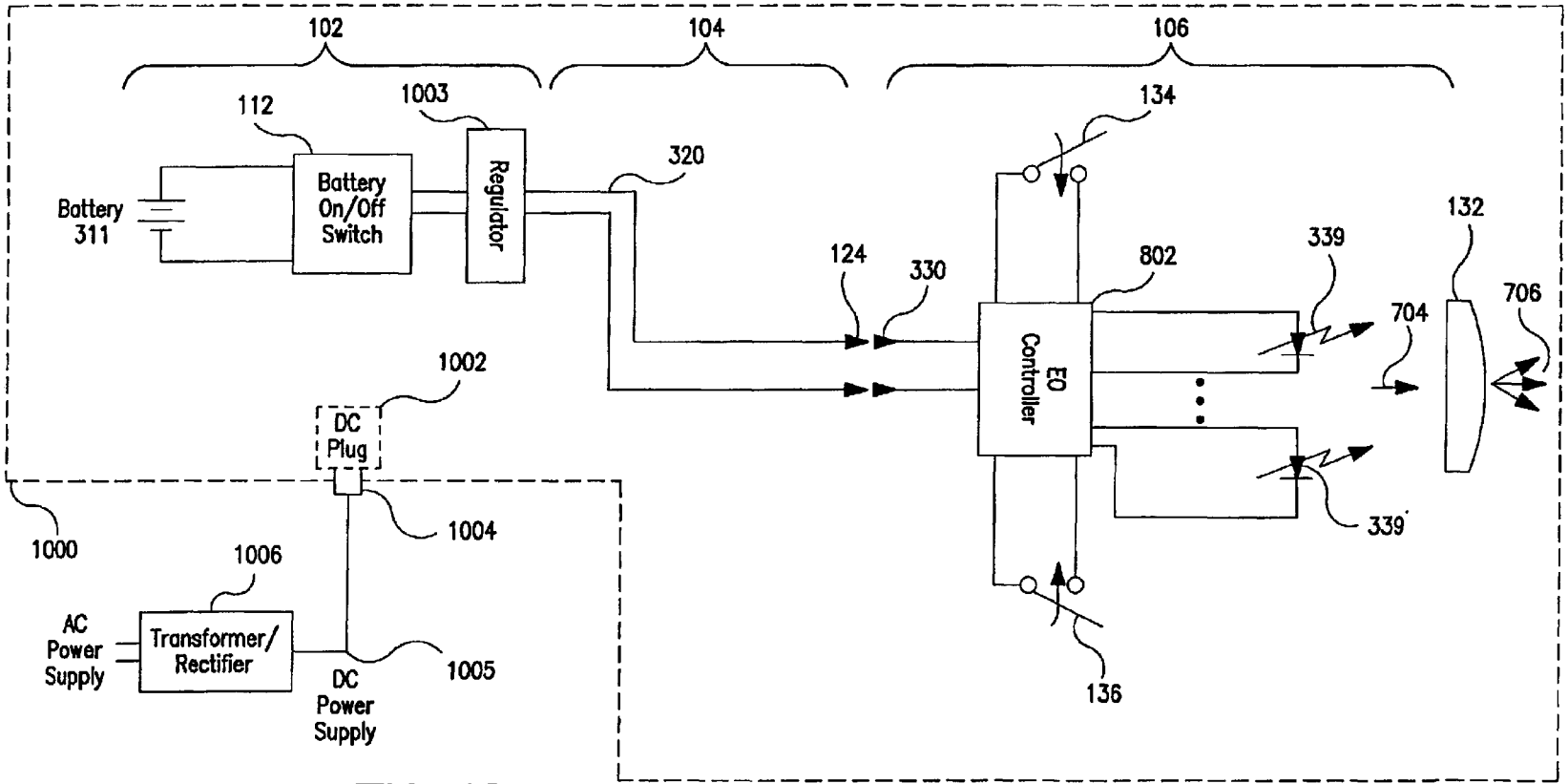
FIG. 10 is a system block diagram of the flexible LED lamp and optional external components.

Referring now to FIG. 10, a block diagram of the system 1000, including the electronic and optoelectronic components utilized in the flexible LED lamp 100, is illustrated. FIG. 10 also illustrates external components that may be used with the flexible LED lamp 100. The external components include a DC power plug 1004, a power cable 1005, and a transformer/rectifier 1006. In one embodiment, the components of the system 1000 include the one or more batteries 311, the battery ON/OFF switch 112, and the regulator 1003 of the base 102; the one or more wires 320 and connector end 124 of the flexible mid region 104; and the connector 330, the intensity/ON/OFF switch 134, the one or more EO converters 339, and the lens 132 of the LED lamp head 106. In another embodiment, the system 1000 further includes the optional color switch 136 to support a multicolor LED lamp head.

In yet another embodiment of the system 1000, the base 102 further includes a DC power connector 1002 to receive power from an external DC source provided by the external components 1004–1006. Instead of using battery power from the one or more batteries 311, line power can be used from an external power source. In this case, an external DC power source (derived from line power) can be used to power the EO converters 339 and/or recharge one or more rechargeable batteries that may be utilized in the flexible LED lamp 100. The transformer/rectifier 1006 converts an AC power supply into desired DC power supply voltages on the power cable 1005 for the electronic components and electro-optic components (i.e., electrical-to-optical controllers 339) of the flexible LED lamp 100, 100'. The DC power provided by the transformer/rectifier 1006 can be a low voltage power supply such as 9 volts.

The one or more batteries 311 couples to the battery ON/OFF switch 112. The battery ON/OFF switch 112 couples to the regulator 1003 which regulates the power to proper voltage and current levels for the LED lamp head 106. The regulator 1003 couples to the one or more wires 320 in the flexible mid region 104. The connector end 124 is coupled to the one or more wires 320 to receive power from the one or more batteries 311 regulated by the regulator 1003, if the switch 112 is turned ON. The connector 330 of the LED lamp head 106, plugs onto the connector end 124 so power can be coupled to the EO controller 802. The intensity/ON/OFF switch 134 is coupled to the EO controller 802 to allow a user to signal the EO controller 802 as to the desired intensity of light and whether the lamp should be turned ON or OFF. The optional switch 136 couples to the EO controller 802 to allow a user to signal the EO controller 802, what color is desired, if a multicolor LED lamp head is provided with multiple colors of EO converters 339. The one or more EO converters 339 couple to the EO controller 802 to be controlled as to whether or not they are turned ON or OFF in generating light/photons. The light source 704 generated by the one or more EO converters 339 is coupled into the lens 132 to generate the diffused output light source 706.

The battery on/off switch 112 powers the electronic and electro-optic components of the flexible LED lamp 100 on and off. No current is utilized by components with the battery ON/OFF switch 112 switched to the OFF position. The battery ON/OFF switch 112 can be a push button switch, a turn-able knob or a sliding switch.

The optional switch 136 in one embodiment functions so that a user can select the color, hint or hue of the light that is desired. In another embodiment, the optional switch 136 may function so that a user can select the intensity or brightness of light that is desired. In another yet embodiment, the optional switch 136 is not provided and the flexible LED lamp 100 has its color and light intensity factory programmed with little user selectivity.

In one embodiment, the color of lighting provided by the linear LED light can be selected by varying the mixture of light generated by red, green, and blue light emitting diodes (LEDs). In an alternate embodiment, the intensity or brightness of the light can also be smoothly varied by varying the current to the light emitting diodes over a range. The current can be varied by proportional amounts to maintain the same color. In yet another alternate embodiment, the intensity or brightness of the light can also be varied at set levels by completely turning ON or OFF one or more light emitting diodes of a same color. The intensity/ON/OFF switch 134 can be used to select a high intensity ON light, a low intensity ON light, and an OFF condition with no light. With the battery ON/OFF switch 112 in the ON position, the EO controller 802 remains powered on to receive inputs from the intensity/ON/OFF switch 134 and optionally switch 136 when selected by a user.

The EO controller 802 receives power through the one or more wires 320 in the flexible mid region 104. It also controls the amount of light output and optionally the color generated by the one or more EO converters, in response to user inputs from the switches 134 and 136. In one embodiment, the EO controller 802 varies the number of electrical-to-optical converters (EOs) 339 that are turned ON in order to change the light intensity in response to inputs from the intensity/ON/OFF switch 134. In another embodiment, the EO controller varies the number of color EO converters 339 that are turned ON and OFF in order that their combination generates the desired color, in response to the optional color switch 136. Alternatively, the EO controller 802 may vary the current supplied to the EO converters 339 in order to control the light intensity and/or the color of light generated.

The flexible LED lamp 100 utilizes solid-state technology. Because it does not use glass bulbs, the flexible LED lamp 100 can withstand harsh treatment from transporting equipment to which its attached from one place to another. The flexible LED lamp 100 does not have a light-bulb that will burn out nor does it generate any significant level of heat, such that it would become warm. The flexible LED lamp can be illuminated in one embodiment to one of any six colors allowing a performer to choose the color to match an aura of a performance or the stage or atmosphere of a club.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art after reading the disclosure. Rather, the invention should be construed according to the claims that follow below.

What is claimed is:

1. A flexible lamp comprising:

a base, wherein the base is a power pack and includes a regulator, and a battery on/off switch;

a flexible mid region coupled at a first end to the base;

a lamp head coupled to a second end of the flexible mid region, the lamp head including one or more electrical-to-optical converters to generate a light source, and a lens to spread the light source out from the lamp head; and the flexible mid region to adjust a location of the lamp head.

2. The flexible lamp of claim 1, wherein the flexible mid region is a goose neck, a flexible neck, a flexible pipe, or a flexible tube.

3. The flexible lamp of claim 1, wherein the power pack further includes one or more batteries.

4. The flexible lamp of claim 1, wherein the power pack further includes a clip or clamp to couple to an object.

5. The flexible lamp of claim 1, wherein the lens further to diffuse the light source generated by the one or more electrical-to-optical converters.

6. The flexible lamp of claim 1, wherein the one or more electrical-to-optical converters include at least one electrical-to-optical converter to generate a red light source, at least one electrical-to-optical converter to generate a green light source, and at least one electrical-to-optical converter to generate a blue light source, and the lens further to diffuse the red light source, blue light source, and green light source into a single color of an output light source from the lamp head.

7. The flexible lamp of claim 6, wherein the single color of the output light source from the lamp head is white.

8. The flexible lamp of claim 1, wherein the lamp head further includes an on/off switch to switch on and off the one or more electrical-to-optical converters.

9. A flexible lamp comprising:

a base, wherein the base includes an on/off switch;

a flexible mid region coupled at a first end to the base;

a lamp head coupled to a second end of the flexible mid region, the lamp head including one or more electrical-to-optical converters to generate a light source, and a lens to spread the light source out from the lamp head; and the flexible mid region to adjust a location of the lamp head and includes one or more wires coupled between the lamp head and the base to provide power thereto.

10. The flexible lamp of claim 9, wherein the lamp head further includes an on/off switch to switch on and off the one or more electrical-to-optical converters.

11. The flexible lamp of claim 10, wherein the lamp head further includes a color switch to select the color of the light source generated by the one or more electrical-to-optical converters.

12. The flexible lamp of claim 9, wherein the one or more electrical-to-optical converters are light emitting diodes (LEDs).

13. The flexible lamp of claim 9, wherein the lamp head further includes a connector for coupling to a connector end of the flexible mid region.

14. The flexible lamp of claim 9, wherein the flexible mid region further includes a barrel jack, and, the lamp head further includes is a barrel plug to plug into the barrel jack and to unplug from the barrel jack to replace the lamp head.

15. The flexible lamp of claim 14, wherein the lamp head to swivel on the flexible mid region when the barrel plug is plugged into the barrel jack.

16. The flexible lamp of claim 9, wherein the lens is made of polycarbonate, acrylic, glass or plastic.

17. The flexible lamp of claim 9, wherein the lens includes a polished flat surface on one side to receive the light source and a curved surface on an opposite side to diffuse the light source.

18. The flexible lamp of claim 17, wherein the curved surface of the lens has a bead blasted surface to further diffuse the light source.

19. The flexible lamp of claim 9, wherein the light source is coupled into the lens and radiated outward therefrom without the use of a fragile glass bulb or filament.

20. The flexible lamp of claim 9, wherein the lamp head further includes a printed circuit board with an electrical-to-optical controller to control the one or more electrical-to-optical converters; and an on/off switch to switch the generation of light by the one or more electrical-to-optical converters on and off.

21. The flexible lamp of claim 20, wherein the lamp head further includes an intensity selection switch to vary the brightness of the generated light.

22. The flexible lamp of claim 20, wherein the lamp head further includes a color selection switch to selectively choose the mixture of primary colors generated by the one or more electrical-to-optical converters to vary the color of the generated light.

23. The flexible lamp of claim 9, further comprising:

a transformer to transform AC power to a safe efficient power to power the one or more electrical-to-optical optical converters in an efficient manner.

24. A flexible lamp comprising:

a support means;

a flexible means coupled at a first end to the support means;

a lamp support means coupled to a second end of the flexible means, the lamp support means including one or more light emitting diodes (LEDs) to generate a light source, and a diffusion means to spread the light source out from the lamp support means; and wherein the support means is a power means and includes an on/off switching means to switch the light source on or off and the flexible means to adjust a location of the lamp support means.

25. The flexible lamp of claim 24, wherein the lamp head includes a connector for coupling to a connector end of the flexible mid region.

26. The flexible lamp of claim 24, wherein the diffusion means is a lens formed out of polycarbonate, acrylic, glass or plastic.

27. The flexible lamp of claim 24, wherein the flexible means is a goose neck, a flexible neck, a flexible pipe, or a flexible tube.

28. The flexible lamp of claim 24, wherein the power means further to couple to line power.

29. The flexible lamp of claim 24, wherein the power means further includes one or more batteries.

30. The flexible lamp of claim 24, wherein the power means further includes a regulation means to regulate voltage and current to the lamp head.

31. A flexible lamp comprising:

a support means, wherein the support means includes a clipping means or a clamp means to couple to an object;

a flexible means coupled at a first end to the support means;

a lamp support means coupled to a second end of the flexible means, the lamp support means including one or more light emitting diodes (LEDs) to generate a light source, and a diffusion means to spread the light source out from the lamp support means; and the flexible means to adjust a location of the lamp support means.

32. A method of forming a flexible lamp, the method comprising:

providing a base including an on/off switch;

coupling a flexible tube to the base at a first end;

forming an LED lamp head including one or more light emitting diodes, the on/off switch of the base to turn on and turn off power to the one or more light emitting diodes; and coupling the LED lamp head to a second end of the flexible tube.

33. The method of claim 32, wherein, the base further includes a regulator to regulate voltage and current to the LED lamp head.

34. The method of claim 32, wherein, the flexible lamp is portable and the base is a power pack to include one or more batteries to provide power to the one or more light emitting diodes.

35. The method of claim 32, wherein, the forming of the LED lamp head includes forming a lens to diffuse a light source generated by the one or more light emitting diodes.

36. The method of claim 35, wherein, the lens is transparent and formed out of polycarbonate, acrylic, plastic, or glass.

37. The method of claim 35, wherein, the forming of the lens includes bead blasting a curved surface to diffuse the light source.

38. A flexible LED light comprising:

a base;

an LED lamp head including one or more light emitting diodes (LEDs) to generate light, and a lens to spread the light generated by the one or more light emitting diodes (LEDs) out from the LED lamp head;

a flexible mid region coupled to the base and to couple to the LED lamp head, the flexible mid region being movable to adjust a location of the LED lamp head coupled thereto; and wherein the base is a power pack and includes a regulator to regulate voltage and current to the LED lamp head, and a battery on/off switch.

39. The flexible LED light of claim 38, wherein the flexible mid region is a goose neck, a flexible neck, a flexible pipe, or a flexible tube.

40. The flexible LED light of claim 38, wherein the power pack further includes one or more batteries.

41. The flexible LED light of claim 40, wherein the power pack further includes a clip or clamp to couple to an object.

42. A flexible LED light comprising:

a base including an on/off switch;

an LED lamp head including one or more light emitting diodes (LEDs) to generate light, and a lens to spread the light generated by the one or more light emitting diodes (LEDs) out from the LED lamp head; and, a flexible mid region coupled to the base and to couple to the LED lamp head, the flexible mid region being movable to adjust a location of the LED lamp head coupled thereto, the flexible mid region including one or more wires coupled between the LED lamp head and the base to provide power thereto.

43. The flexible LED light of claim 42, wherein the LED lamp head further includes an on/off switch, and one or more wires coupled to the LED lamp head to provide power thereto.

44. The flexible LED light of claim 43, wherein the lamp head further includes a color switch to select the color of the light source generated by the one or more electrical-to-Optical converters.

45. The flexible LED light of claim 42, wherein the LED lamp head further includes an on/off switch, and the base further includes one or more batteries to provide power thereto.

46. The flexible LED light of claim 42, wherein the lamp head further includes a color switch to select the color of the light source generated by the one or more electrical-to-optical converters.

47. The flexible LED light of claim 42, wherein the one or more light emitting diodes (LEDs) are a plurality of light emitting diodes (LEDs) to generate one or more colors of light in the light source.

48. The flexible LED light of claim 47, wherein the plurality of light emitting diodes (LEDs) generate a plurality of colors of light and the LED lamp head further includes a color switch to select one shade of the plurality of colors of light for the plurality of light emitting diodes (LEDs) to generate.

49. The flexible LED light of claim 48, wherein the LED lamp head further includes an electrical to optical (EO) controller coupled to the color switch to control the plurality of light emitting diodes (LEDs) to generate the selected shade of color of light.

50. The flexible LED light of claim 42, wherein the LED lamp head is detachable and includes a connector for coupling to a connector end of the flexible mid region.

51. The flexible LED light of claim 42, wherein the lens is made of polycarbonate, acrylic, glass or plastic.

52. The flexible LED light of claim 42, wherein the lens includes a polished flat surface on one side to receive the light source and a curved surface on an opposite side to diffuse the light source.

53. The flexible LED light of claim 52, wherein the curved surface of the lens has a bead blasted surface to further diffuse the light source.

54. The flexible LED light of claim 42, wherein the LED lamp head further includes an ON/OFF switch to selectively turn on and off the plurality of light emitting diodes (LEDs) to select a desired intensity of light.

55. The flexible LED light of claim 54, wherein the LED lamp head further includes an electrical to optical (EO) controller coupled to the ON/OFF switch to control the plurality of light emitting diodes (LEDs) to generate the selected intensity of light.

56. The flexible LED light of claim 42, wherein the light generated by the one or more light emitting diodes (LEDs) is coupled into the lens and radiated outward therefrom without the use of a fragile glass bulb or filament.

57. A flexible LED lamp comprising:

a lamp head including one or more light emitting diodes to generate one or more light sources, a lens to receive the one or more light sources and to diffuse the one or more light sources into a single output light from the lamp head, a user selector switch to select the single output light from the lamp head, a barrel plug to couple the lamp head to the flexible lamp and to receive power;

a base including an on/off switch, a clip, and one or more batteries to selectively couple power to the lamp head, the on/off switch to selectively couple power to the lamp head, the clip to couple the flexible lamp to an object; and a gooseneck coupled to the base, the gooseneck to adjust a location of the lamp head, the gooseneck including one or more wires and a barrel jack, the one or more wires to couple power from the base to the barrel jack, the barrel jack to couple to the barrel plug of the lamp head.

58. The flexible LED lamp of claim 57, wherein the base further to couple to an external power source to selectively couple power to the lamp head.

59. The flexible LED lamp of claim 57, wherein the one or more light emitting diodes include at least one light emitting diode to generate a red light source, at least one light emitting diode to generate a green light source, and at least one light emitting diode to generate a blue light source, and the lens to diffuse the red light source, blue light source, and green light source into a single color of the single output light from the lamp head.

60. The flexible LED lamp of claim 59, wherein the single color of the output light source from the lamp head is white.

61. The flexible LED lamp of claim 57, wherein the user selector switch to select the color of the single output light from the lamp head.

62. The flexible LED lamp of claim 57, wherein the user selector to select the intensity of the single output light from the lamp head.

63. The flexible LED lamp of claim 57, wherein the lens includes a polished flat surface on one side to receive the one or more light sources and a curved surface on an opposite side to diffuse the one or more light sources into the single output light.

64. The flexible LED lamp of claim 63, wherein the curved surface of the lens has a bead blasted surface to further diffuse the one or more light sources.

65. The flexible LED lamp of claim 57, wherein the lamp head further includes a printed circuit board with a controller to control the one or more light emitting diodes.

66. The flexible LED lamp of claim 57, wherein the lamp head further includes an on/off switch to selectively power on and off the one or more light emitting diodes to turn on and off the single output light.

67. The flexible LED lamp of claim 57, wherein the barrel plug and the barrel jack to allow replacement of the lamp head.

68. The flexible LED lamp of claim 57, wherein the barrel plug and the barrel jack to allow the lamp head to swivel.

* * * * *